United States Patent [19]

Hettinger, Jr. et al.

[11] Patent Number: 4,515,900

[45] Date of Patent: May 7, 1985

[54] SORBENT USEFUL IN A VISBREAKING TREATMENT OF CARBO-METALLIC OILS

[75] Inventors: William P. Hettinger, Jr.; Hubert W. Beck, both of Russell, Ky.

[73] Assignee: Ashland Oil, Inc., Ashland, Ky.

[21] Appl. No.: 509,100

[22] Filed: Jun. 30, 1983

Related U.S. Application Data

[63] Continuation of Ser. No. 281,797, Jul. 9, 1981, abandoned.

[51] Int. Cl.[3] ..... B01J 21/16

[52] U.S. Cl. ..... 502/63; 502/84; 502/87; 502/521

[58] Field of Search ..... 502/80, 84, 87, 439, 502/63, 521

[56] References Cited

U.S. PATENT DOCUMENTS

| | | | |
|---|---|---|---|
| 2,582,956 | 1/1952 | Bond, Jr. | 252/450 |
| 2,584,148 | 2/1952 | Mills | 252/450 |
| 2,744,056 | 5/1956 | Offutt et al. | 252/449 X |
| 2,840,530 | 6/1958 | Milliken, Jr. et al. | 252/455 Z |
| 2,934,504 | 4/1960 | Talvenheimo | 252/450 |
| 3,049,449 | 8/1962 | Allegrini | 252/449 X |
| 3,746,659 | 7/1973 | Horzepa | 252/448 |

*Primary Examiner*—Carl F. Dees

*Attorney, Agent, or Firm*—Richard C. Willson, Jr.; Stanley M. Welsh

[57] ABSTRACT

A solid sorbent particulate, its method of preparation and use is disclosed for the treatment of a residual hydrocarbon oil feed, etc. comprising metal contaminants and high carbon forming constituents with a high pore volume solid sorbent material of at least 0.4 cc/g in a visbreaking zone in which operation the effectiveness of the high pore volume sorbent material is further improved by a metal additive to immobilize low melting point vanadium compounds. The sorbent pore volume, sorbent to oil ratio and operating conditions are such that the volume of sorbent pores filled with oil feed is limited to the range of $\frac{1}{4}$ to $\frac{2}{3}$ and along with carbonaceous material and metal contaminants are encouraged to deposit within the pores rather than on the exterior surface of the solid sorbent in a hydrothermal visbreaking operation in the absence of added molecular hydrogen.

8 Claims, 4 Drawing Figures

SORBENT USEFUL IN A VISBREAKING TREATMENT OF CARBO-METALLIC OILS

This application is a continuation, of application Ser. No. 281,797, filed 7/09/81 now abandoned.

TECHNICAL FIELD

This invention relates to producing a more suitable grade of oil feed material from the bottom of the barrel having lowered metals and Conradson carbon values for use as feedstock in a reduced crude conversion (RCC) process or a present day modern FCC process. A high boiling portion of crude oil comprising a poor grade of carbo-metallic oil components having high metals and Conradson carbon values is converted according to this invention to a lower metals containing feed suitable for an RCC process. More particularly, this invention is related to the preparation and use of a solid particulate sorbent material with and without metal additives provided to particularly immobilize vanadium compounds deposited on the sorbent particulate during treatment of the metals containing oil feed. The metal additive for vanadium immobilization may be added during sorbent manufacture, after manufacture by impregnation of the virgin sorbent, or at any point in the sorbent hydrocarbon contact and regeneration cycle for treatment of the oil feed.

BACKGROUND OF THE INVENTION

A major breakthrough in FCC catalysts and method of use came in the early 1960's with the introduction of molecular sieves or zeolites. These materials were incorporated into the matrix of amorphous and/or amorphous/kaolin materials constituting the FCC catalysts of that time. These new zeolitic catalysts, containing a crystalline aluminosilicate zeolite in an amorphous or amorphous/kaolin matrix of silica, alumina, silica-alumina, kaolin, clay or the like, were at least 1,000–10,000 times more active for cracking hydrocarbons than the earlier amorphous or amorphous/kaolin containing silica-alumina catalysts. This introduction of zeolitic cracking catalysts revolutionized the fluid catalytic cracking process. New innovations were developed to handle these high activities, such as riser cracking, shortened contact times, new regeneration processes, new improved zeolitic catalyst developments, and the like.

The new catalyst developments revolved around the development of various zeolites such as synthetic types X and Y and naturally occurring faujasites; increased thermal-steam (hydrothermal) stability of zeolites through the inclusion of rare earth ions or ammonium ions via ion-exchange techniques; and the development of more attrition resistant matrices for supporting the zeolites.

These zeolitic catalyst developments gave the petroleum industry the capability of greatly increasing throughput of feedstock with increased conversion and selectivity while employing the same units without expansion and without requiring new unit construction.

After the introduction of zeolite containing catalysts, the petroleum industry began to suffer from a lack of crude availability as to quantity and quality accompanied by increasing demand for gasoline with increasing octane values. The world crude supply picture changed dramatically in the late 1960's and 1970's. From a surplus of light, sweet crudes, the supply situation changed to a tighter supply with an ever increasing amount of heavier crudes with higher sulfur contents. These heavier and higher sulfur crudes presented processing problems to the petroleum refiner in that these heavier crudes invariably also contained much higher metals and Conradson carbon values, with accompanying significantly increased asphaltic content.

The effects of heavy metal and Conradson carbon on a zeolite containing FCC catalyst have been described in the literature as to their highly unfavorable effect in lowering catalyst activity and selectivity for gasoline production and their equally harmful effect on catalyst life.

Metal content and Conradson carbon are two very effective restraints on the operation of a FCC unit and impose restraints on a Reduced Crude Conversion (RCC) unit from the standpoint of obtaining maximum conversion, selectivity and catalyst life. Relatively high levels of these contaminants are highly detrimental to a catalytic conversion process. As metals and Conradson carbon levels are increased still further by available crude oils, the operating capacity and efficiency of a RCC unit and especially a FCC unit are adversely affected or even made uneconomical. These adverse effects occur even though there is enough hydrogen in the feed to produce an ideal gasoline consisting of a mixture of only toluene and isomeric pentenes (assuming a catalyst with such ideal selectivity could be devised).

The effect of increased Conradson carbon is to increase that portion of the feedstock converted to coke deposited on the catalyst. In typical gas oil cracking operations employing a crystalline zeolite containing catalyst in an FCC unit, the amount of coke deposited on the catalyst averages about 4–5 wt % of the feed. This coke production has been attributed to four different coking mechanisms, namely, contaminant coke from adverse reactions caused by metal deposits, catalytic coke caused by acid site cracking, entrained hydrocarbons resulting from pore structure adsorption and/or poor stripping, and Conradson carbon resulting from pyrolytic distillation of hydrocarbons in the conversion zone. There has also been postulated two other sources of coke present in reduced crudes in addition to the four above identified. They are: (1) adsorbed and absorbed high boiling hydrocarbons which do not vaporize and cannot be removed by normally efficient stripping, and (2) high molecular weight nitrogen containing hydrocarbon compounds adsorbed on the catalyst's acid sites. Both of these two types of coke producing phenomena add greatly to the complexity of resid oil processing. Therefore, in the processing of the higher boiling fractions or portions of crude oil, e.g., reduced crudes, residual fractions, topped crude, and the like, the coke production based on feed is the summation of the four types present in gas oil processing, plus coke from the higher boiling unvaporizable hydrocarbons and coke associated with the high boiling nitrogen containing molecules which are adsorbed on the catalyst. Coke production on clean catalyst, when processing reduced crudes, may be estimated as approximately 4 wt % of the feed plus the Conradson carbon value of the heavy feedstock, plus an additional correction factor related to % of feed boiling above 1050° F. and % nitrogen in the feed.

The coked catalyst is brought back to equilibrium activity by burning off the deactivating coke in a regeneration zone in the presence of air and the regenerated catalyst is recycled back to the reaction zone. The heat generated during regeneration is removed in part by the catalyst and carried to the reaction zone for vaporization of the feed and to provide heat for the endothermic cracking reaction. The temperature in the regenerator is normally limited because of metallurgical limitations and the hydrothermal stability of the catalyst.

The hydrothermal stability of a crystalline zeolite containing catalyst is determined by the temperature and steam partial pressure at which the crystalline zeolite begins to rapidly lose its crystalline structure and to yield a lower activity amorphous material. The presence of steam in high temperature operating modes is highly critical and is generated by the burning of adsorbed and absorbed (sorbed) carbonaceous material which has a significant hydrogen content (hydrogen to carbon atomic ratios generally greater than about 0.5). This carbonaceous material is principally the high boiling sorbed hydrocarbons with boiling points as high as 1500°–1700° F. or above that have a modest hydrogen content and the high boiling high molecular weight nitrogen containing hydrocarbons, as well as related porphyrins and asphaltenes. The high molecular weight nitrogen compounds usually boil above 1025° F. and may be either basic, acidic or neutral in nature. The basic nitrogen compounds may neutralize acid sites while those that are more acidic may be attracted to metal sites on the catalyst. The porphyrins and asphaltenes also generally boil above 1025° F. and may contain elements other than carbon and hydrogen. As used in this specification, the term "heavy hydrocarbons" includes all carbon and hydrogen containing compounds that do not boil below about 1025° F., regardless of whether other elements are also present in the compound.

The heavy metals in the feed are generally present as porphyrins and/or asphaltenes. However, certain of these metals, particularly iron and copper, may be present as the free metal or as inorganic compounds resulting from either corrosion of process equipment or contaminants from other refining processes.

As the Conradson carbon value of the feedstock increases, coke production increases and this increased load will raise the regeneration temperature; thus the unit may be limited as to the amount of feed that can be processed because of its Conradson carbon content. A new development in reduced crude processing as described in pending U. S. applications referenced below, can operate at regenerator temperatures in the range of 1350° up to 1600° F. But even these higher regenerator temperatures place a limit on the Conradson carbon value of the feed at approximately 8, which yields about 12–13 wt % coke on the catalyst based on the weight of the feed. This level is controlling unless considerable water is introduced to further control temperature.

The metal containing fractions of reduced crudes contain Ni-V-Fe-Cu in the form of porphyrins and asphaltenes. These metal containing hydrocarbons are deposited on the catalyst during processing and are cracked to some extent to deposit the metal on the catalyst or are carried over by the coked catalyst as the metallo-porphyrin or asphaltene and converted by burning to the metal oxide during regeneration. The adverse effects of these metals as taught in the literature are to cause non-selective or degradative cracking and dehydrogenation to produce increased amounts of coke and light gases such as hydrogen, methane and ethane. These mechanisms adversely affect selectivity, resulting in poor yields and quality of gasoline and light cycle oil. The increased production of light gases, while impairing the yield and selectivity also have an undesirable effect on the gas compressor capacity. The increase in coke production, in addition to its negative impact on yield, also adversely affects catalyst activity-selectivity, greatly increases regenerator air demand and compressor capacity, and may result in uncontrollable and/or dangerous regenerator temperatures.

These problems of the prior art have been greatly minimized by the development of a new process which can handle reduced crudes or crude oils containing high metals and Conradson carbon values previously not acceptable for direct FCC processing. Normally, the less desirable crudes require expensive vacuum distillation and other treatments to isolate suitable metals free feedstocks and produce as a by-product, sulfur containing vacuum still bottoms. However, certain crude oils such as Mexican Mayan or Venezuelan crude oils contain abnormally high metals and Conradson carbon values. If these poor grades of crude are processed directly in a catalytic cracking process, they will lead to an uneconomical operation because of the high burning load imposed on the regenerator to remove carbonaceous deposits catalyst deactivation by metals and a high catalyst addition rate required to maintain catalyst activity and selectivity. The addition rate can be as high as 4–8 lbs./bbl. or more which at today's catalyst prices, can add as much as $2–8/bbl. of additional catalyst cost to the processing economics. It is thus desirable to develop and identify an economical means of processing more of the poor grade crude oils, such as a Mexican Mayan, because of their availability and relative cost as compared to Middle East crudes.

The literature suggests many processes for the reduction of the metals content and Conradson carbon values of reduced crudes and other contaminated oil fractions. One such process is that described in U.S. Pat. No. 4,243,514 and German Pat. No. 29 04 230 assigned to Englehard Minerals and Chemicals, Inc., which patents are incorporated herein by reference. Basically, these prior art processes involve contacting a reduced crude fraction or other contaminated oil with sorbent material at elevated temperatures in a sorbing zone, such as a fluid bed, to produce a product of reduced metal and reduced Conradson carbon value. One of the sorbents described in U.S. Pat. No. 4,243,514 is an inert solid initially composed of kaolin, which has been spray dried to yield microspherical particles having a surface area below 100 $m^2/g$ and a catalytic cracking micro-activity (MAT) value of less than 20 which material is subsequently calcined at high temperature so as to achieve better attrition resistance. As the vanadia content on such sorbents increases above 5000 ppm and into the range of 10,000–30,000 ppm, the sorbent begins to have fluidization problems and more importantly, coking plugging of the reactor riser which have been overcome previously by removal of most of the spent sorbent inventory and addition of fresh virgin material in place thereof. This plugging may require shutting down the sorbent contacting facility.

DISCLOSURE OF THE INVENTION

The present invention is concerned with and provides a method of producing a higher grade of feedstock for catalytic conversion such as in a reduced crude catalytic conversion (RCC) process having lowered metals and Conradson carbon values from a poor grade of crude oil or other carbo-metallic containing oil components having extremely high metals and Conradson carbon producing values.

The invention is also applicable to processing crude oils or crude oil fractions comprising significant levels of metals and/or Conradson carbon producing components to provide an improved feedstock suitable for RCC processing, or for use in a typical gas oil fluid catalytic (FCC) cracking process.

Residual fractions obtained from the distillation of poor quality crude oils contain substantial amounts of metals such as Ni, V, Fe, Cu, Na and have high Conradson carbon producing materials. These residual oils are made more suitable as feedstocks according to this invention for processing by catalytic conversions as in a reduced crude conversion (RCC) affecting a preliminary contacting of the poor quality high boiling oil containing residual oil fraction with a solid sorbent particle material exhibiting relatively low or no significant catalytic cracking activity less than about 20 MATS under conditions of time, pressure and temperatures sufficient to reduce the metals and Conradson carbon values of the feed within more acceptable limits for catalytic cracking processing.

It has been found for example, that as vanadium pentoxide and/or sodium vanadates build up on a sorbent particulate, the elevated temperatures encountered in the sorbent regeneration zones to remove carbonaceous deposits cause significant levels of vanadia deposits to flow and form a liquid coating on the sorbent particles. Under this condition an interruption or decrease in particle flow result in coalescence between the liquid coated sorbent particles. Once coalescence occurs, fluidization is interrupted and becomes difficult to reinitiate. This condition results for example in stoppage of particle flow in cyclone diplegs, ineffective operation of cyclones, rapid increases in the loss of the sorbent, and will finally result with unit shutdown.

In a particular aspect, the present invention is concerned with providing an improved sorbent particle material for use in a process such as described in the identified copending application Ser. No. 277,752, modified as herein provided and referred herein to as a hydrothermal visbreaking process. In this hydrovisbreaking operation, it has been recognized that significant economics can be realized in conjunction with improving the operation for metals removal and decarbonization of the feed when employing sorbent particulate material particularly identified herein. The present invention is thus concerned with an improved sorbent particulate material characterization, its method of preparation and method of use in a hydrothermal visbreaking operation in the absence of added molecular hydrogen.

The improved solid sorbent particulate material of this invention, particularly comprises a high pore volume clay type material composition of at least 0.4 cc per gram (cc/g) pore volume used with or without one or more metal additive molecules for immobilizing liquidized vanadia, said composition providing greater absorbence characteristics for heavy oil components and greater sorbent stability at the temperature conditions employed up to 1600° F. In yet another aspect, the improved sorbent material is of a pore size and volume which readily absorbs high levels of metal deposits and high boiling components of the residual oil feed within its pores in preferance to surface deposition contributing to particle agglomeration. Surface deposition of metals, particularly vanadia, contributes to reducing the absorption characteristics of the sorbent by blocking pore openings and causing coalescence of particles as herein described. Thus the improved high pore volume material of this invention, allows more contaminating metal components such as vanadium and asphaltenes to be absorbed within the sorbent pores rather than collect on the particle outer surface. The use of the high pore volume sorbent material considerably reduces the tendency for particle coalescence due to high metals bonding as observed with low pore volume sorbent material. Furthermore, relatively large volumes of the heavy bottoms boiling above 1025° F. result in particle coating of low pore volume material with a tacky asphaltic material which also facilitates coalescence of particles, resulting in plugging and coking within a riser reactor and product separator lines. However, by employing the larger pore volume material in conjunction with restricting the volume of the pores occupied by the heavy oil feed as herein provided, the loading for asphaltic material to cause particle coalescence is considerably reduced over an extended operating period.

The ability of a reduced crude cracking process to handle crude oil is limited by its Conradson carbon characteristics and particularly by the concentration of metal contaminants in the feed and more particularly by the concentration of vanadia in the high boiling portion of the crude oil being processed. In this regard, it is generally recognized prior to this invention that an upper limit for the oil feed to an RCC unit is associated with a Conradson carbon of about 8% and a total metals content considerably below about 50 ppm Ni+V. Thus in order to process crude oils comprising high metals level, greater than 100 ppm Ni+V and a Conradson carbon value above 8% such as found in Mexican Mayan crude oil (17% Conradson carbon and total metals of 400 ppm), an efficient as well as an economic metals removal system—Conradson carbon reduction system is required upstream or in front of a catalytic cracking (FCC) or a reduced crude cracking (RCC) operation.

In a known prior art metals removal system, a sorbent material of low catalytic activity is used to absorb a portion of the Conradson carbon and metals on its surface. In this operation, the sorbent surface area is low, about 25 $m^2/g$ or less and its corresponding pore volume is also low, approximately about 0.2 cc/g or less. An equilibrium sorbent of these characteristics has an even much lower pore volume of about 0.15 cc/g and less, down to about 0.10 cc/g or even lower 0.06 cc/g. When using a sorbent material of these characteristics to provide solids to oil ratio in the range of 6–8, it is quite apparent that the absorption power of the sorbent particulate is less than the volume of feed being processed. Thus the rapid deposition of hydrocarbonaceous material, metal contaminants and tacky asphaltic material on a sorbent particle of such limited characteristics can rapidly cause pore plugging and excessive coverage of the exterior surface of the sorbent particle promoting particle coalescence or agglomeration. It has been noted and identified in applicants copending application Ser. No. 277,752 that vanadia deposited on the surface of the solid sorbent will flow as a liquid under high temperature conditions of operation encountered in a regeneration zone to remove deposited carbonaceous material and such vanadia flow causes particle sintering, pore collapse and particle coalescence in cooler areas of the sorbent contacting unit and more static flow areas. When such particles coalescence is permitted to occur such as in standpipes, cyclone diplegs and related somewhat stagnant particle flow areas, there is a loss in fluidization and flow characteristics of the solid sorbent particulate which rapidly contributes to stoppage and shutdown of the process.

Furthermore as recited above when using a low pore volume solid sorbent material, the heavy high boiling oil components comprising asphalt is not absorbed but coats the particle with unvolatilized asphalt which then serves as a sticky mass to cause particles to stick together and to the riser reactor wall eventually resulting in plugging of the riser reactor and product separator. This problem is also observed in fluid coking operations where coke microspheres unable to absorb the oil feed readily coalesce to form large lumps and eventual plugging of the system.

The present invention is therefore concerned with providing an improved solid sorbent particulate material which will materially reduce if not eliminate such an undesirable operation of solids loading of contaminants and resultant defluidization thereof.

In accordance with the present invention, the adverse conditions herein identified with respect to pore plugging, particle sintering and particle coalescence is substantially reduced through the use of a large pore volume solid sorbent particulate material such as one containing a pore volume of at least 0.4 cc/g and preferably in the range of 0.5 cc/g up to about 0.8 cc/g pore volume. In yet another aspect the present invention is concerned with methods of preparation of the desired large pore volume and thermally stable solid sorbent particulate material. The sorbent characteristics of the large pore material may be improved by adding one or more additive metals defined below which will be effective in immobilizing the flow of vanadia at regeneration temperature conditions by combining therewith to form higher melting point materials following deposition on the sorbent material.

A particularly desired high pore volume clay sorbent material may be attained during preparation thereof by the incorporation of one or more of the components of carbon black, sugar, organic materials such as methylcellusolve, starch; polymer materials such as nylon, polyacrylonitriles, polybutenes, polystyrenes; high temperature decomposition of inorganic salts such as nitrates, nitrites, carbonates, sulfites of various molecular weights and structure to get a desired pore size following decomposition.

The large pore solid sorbent particulate materials provided and prepared according to this invention are to be employed in apparatus similar to that disclosed in Ser. No. 277,752, but under operating conditions specifically recited herein, in which operation, the solids of this invention are employed for a greatly extended on stream operating time thereby contributing measurably to the economics and efficiency of the operation. Other advantages contributed by the solid sorbent materials of this invention will become more apparent from the following discussion.

The sorbent particulate material of this invention may be prepared in a specific case by mixing one or more of carbon black, a polymeric material decomposable during high temperature drying or subsequent high temperature treatment, sugar, etc. in a slurry of clay such as kaolin, montmorillonite smectite or other suitable material, which mixture is thereafter spray dried to yield a microspherical sorbent particulate of a size in the range of about 20 to about 150 microns and preferably within the fluidizable particle range of 40 to 80 or more microns. Calcination of the spray dried material may be accomplished in the regeneration step of the process or separately effected before use at a temperature sufficient to remove carbon black by burning or decompose organic material whichever employed to yield the desired large pore sorbent material. Thus the pore size of the sorbent material is determined essentially by the size of the occluded material removed by calcination and/or burning. A preferred pore volume of the finished microspherical sorbent is at least 0.4 cc/g and preferably is within the range of 0.5 to about 0.8 cc/g. Thus when one employs a sorbent/oil ratio of 7/1, the total pore volume of the sorbent will be within the range of about 2.8 cc/cc of feed up to about 5.6 cc/cc of feed. With this larger sorbent pore volume than employed heretofore, the pores will not be over filled with deposited high boiling carbon producing component materials and metal contaminants for a much longer period of operating time deposited hydrocarbonaceous material is removed by burning, and deposited vanadia will be discouraged from flowing from the pores with or without additive metals to accumulate on the outer surface of the solid particle and cause pore plugging and coalescence.

In addition to the substantially increased pore volume provided by the sorbent material of this invention being a deterrent to short term operation, the increased pore volume in combination with immobilizing metal additives further enhances the hydrothermal visbreaking operation of this invention by permitting an even much larger accumulation of metal contaminants on the sorbent material before discard thereof is required.

The large pore sorbent material of this invention may be modified as suggested above by the inclusion of one or more vanadia immobilizing metal additives selected from the oxide or salt thereof or an organo-metallic compound of the additive material may be added to the sorbent material during or after manufacture of the sorbent particulate or during the oil processing cycle so as to immobilize for example sodium vanadates, and/or vanadium pentoxide deposited on the sorbent during processing of the oil for metals and/or Conradson carbon removal. With the large pore volume sorbent material there is less need for providing an additive metal herein identified in the virgin sorbent material. Addition after considerable accumulation of vanadia will be helpful.

The described invention thus provides an improved sorbent and an improved method for treatment of high boiling oil feeds containing significant levels of hydrocarbon materials boiling above 1025° F. and an amount of vanadium of at least 1.0 ppm. More particularly, the sorbent particulate material of improved high pore volume and metals adsorption capacity reduces also the phenomenon of particle coalescence and loss of fluidization for the reasons herein described and caused in part particularly by vanadium compound contaminants of low melting point. Gas oil and heavier high boiling portions of oil feeds of all types utilized in FCC operation and more particularly in reduced crude cracking operation comprise vanadium, nickel, iron and copper in considerably varying amounts with vanadium quite often being a major portion thereof. The invention described herein is thus particularly useful in the removal of excessive carbo-metallic containing oil components from feeds to be utilized in a process known as a reduced crude cracking (RCC) process processing hydrocarbon composition of higher metals content than processed in gas oil cracking (FCC) operations.

Some crude oil fractions and some FCC charge stocks obtained by the distillation of crude oils contain significant amounts (greater than 1.0 ppm) of heavy metals such as Ni, V, Fe, Cu, Na. Of these metals, vanadium has been identified as a particularly bad actor as herein described. Residual fractions from crude oil distillation have even greater amounts of heavy metals and also have high Conradson carbon producing hydrocarbons. As used throughout the specifications, "vanadia" refers collectively to the oxides of vanadium. It has been found that as the vanadium oxide level builds up on the sorbent material the elevated temperatures encountered in the regeneration zone cause vanadium pentoxide ($V_2O5$) to flow as liquid vanadia. This flowing of vanadia, particularly at high vanadia levels in sorbent materials with low surface area and low pore volume below 0.4 cc/g and particularly below 0.2 cc/g can also coat the outside of the sorbent microspheres with liquid and thereby cause coalescence in cooler areas between sorbent particles which adversely affect its fluidization properties. It is to be understood that the large pore volume sorbent particles of this invention can be of any size, depending on the size appropriate to the conversion process in which the sorbent is to be employed. Thus, while a fluidizable size is preferred in a riser contact zone, the sorbent particles may be employed as larger size particles, such as those used in solid particle moving beds systems in contact with partially vaporized or unvaporized feeds.

Many of the problems of the prior art related to reduced crude cracking are believed to be caused by asphaltic and vanadium containing contaminants and such problem are overcome in substantial measure by employing the large pore sorbent particle material of this invention either alone or in combination with a select metal additive herein identified for at least part of the sorbent life in the process.

This invention is especially effective for the treatment of reduced crudes, residual oils, topped crudes and other high boiling carbo-metallic containing hydrocarbon feeds comprising relatively high vanadium to nickel ratios and high Conradson carbon values. The hydrocarbon fractions or high boiling oil feeds having a high level of metal contaminants and Conradson carbon producing components values are preferably initially contacted in a reaction zone such as a riser reactor zone with a diluent material such as water, steam or a combination thereof to provide temperature control and hydrocarbon partial pressure reduction upon contact with the solid sorbent particulate material of this invention providing surface area and high pore volume herein defined at temperatures above about 900° F. Residence time of the oil feed charged will vary with boiling range and generally is below 5 seconds. Preferably the residence time for high boiling residual oils and reduced crude will be in the range of 0.5–3 seconds. The preferred high pore volume sorbent material according to this invention of fluidizable particle size is a spray dried composition in the form of microspherical particles generally in the size range of 20 to 150 microns and preferably between about 40 and about 80 microns, which may or may not be calcined prior to use.

DISCUSSION OF SPECIFIC EMBODIMENTS

Figure 1:
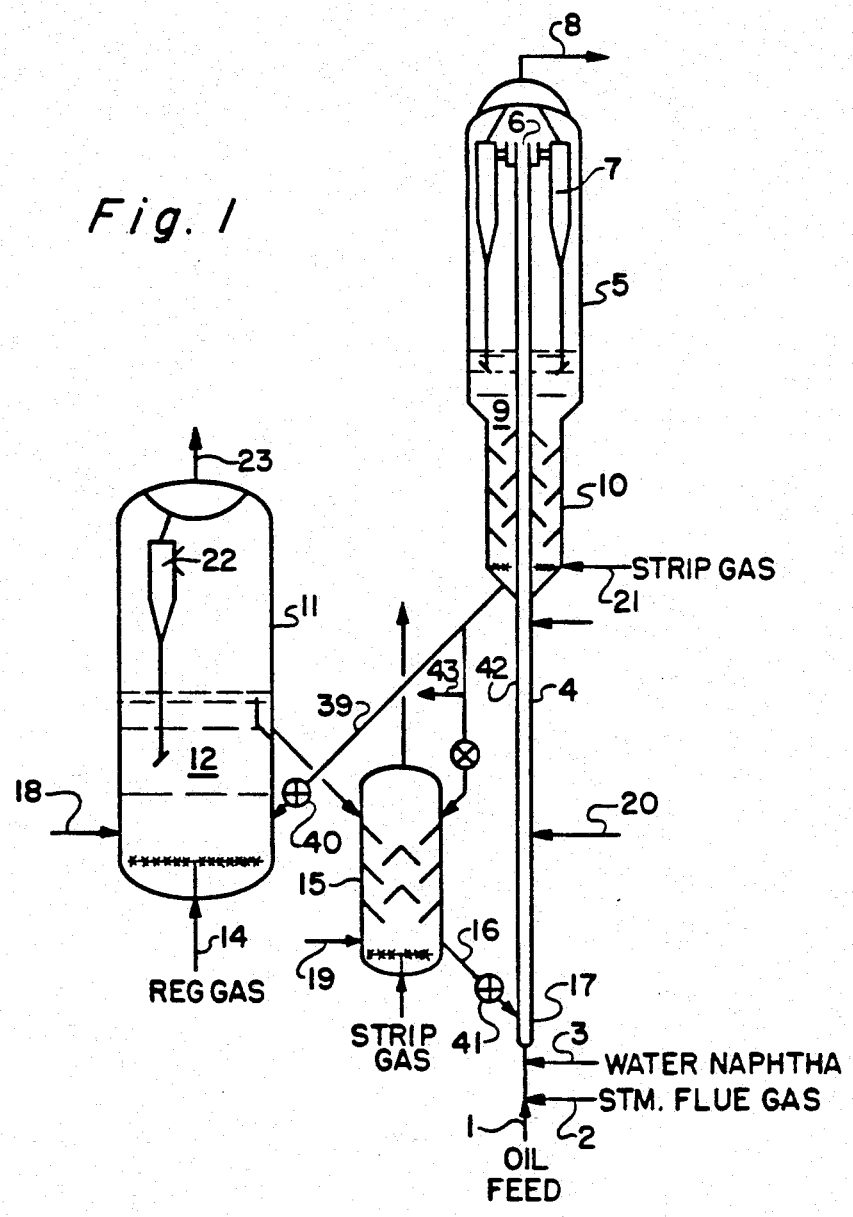
FIG. 1 is a schematic diagram in elevation of an arrangement of an apparatus for carrying out the visbreaking-demetallizing process of the invention.

It is not proposed to specifically define the exact mechanism for obtaining the immobilization of vanadia except to say that metal additives of this invention will form compounds, complexes or alloys with vanadia which have higher melting points than the temperatures permitted to be achieved in the regeneration operation. The atomic ratio of additive metal to vanadium desirably employed on the sorbent material is at least 0.5 and preferably at least 1.0 depending on the number of additive metal atoms in the oxide of the additive metal, e.g. $TiO_2$ or $In_2O_3$, form a stable, high melting binary oxide material with vanadium pentoxide ($V_2O_5$). Thus, the melting point of the binary oxide material is generally well above the operating temperatures to be encountered in the regenerator. Although, the amount of metal additive may be initially considerably above the preferred minimum ratio depending upon procedure employed for addition thereof and particularly if it is incorporated in the solid sorbent prior to use, the ratio of additive metal to vanadium on the sorbent will decrease as vanadium is deposited on the solid sorbent. Alternatively, the metal additive may be added to the process at a preferred and selected minimum rate at least equivalent to the vanadium metal content of the feed. This or any other suitable approach may be employed to identify and confirm suitable metal additive concentrations which can form binary mixtures with deposited and/or formed low melting point vanadia so as to yield a solid material that has a melting point of at least about 1600° F. and preferably at least about 1700° F. or higher. This high melting point product ensures that high levels of vanadia will not flow, so as to cover the sorbent pore structure to cause particle coalescence and/or sintering as herein described.

EXAMPLES OF ADDITIVES

The additive metals of this invention include those elements from the Periodic chart of elements shown in Table A. The melting points of Table A are based on a 1:1 mole ratio of the metal additive oxide in its stable valence state under regenerator conditions to vanadium pentoxide.

TABLE A

| | | M.P. of 1/1 Mixture - °F. |
|---|---|---|
| Group IIA | Mg, Ca, Sr, Ba | <1740 |
| Group IIIB | Sc, Y, La | 1800–2100 |
| Group IVB | Ti, Zr, Hf | 1700–2000 |
| Group VB | Nb, Ta | 1800–2000 |
| Group VIIB | Mn, Tc, Re | <1750 |
| Group VIII | Ni, Ru, Rh, Pd, Os, Ir, Pt | <1600 |
| Group IIIA | In, Tl | <1800 |
| Group VA | Bi, As, Sb | <1600 |
| Lanthanide Series | All | <1800 |

TABLE A-continued

| | | M.P. of 1/1 Mixture - °F. |
|---|---|---|
| Actinide Series | All | <1800 |

Other elements which may be employed with considerable success include silicon and aluminum. In particular it is desirable to employ with the large pore volume kaolinite clay from 1 to 20 wt % of one or more of Si, Al, Ti, Zr, Ba, Mg and Ca.

This invention also recognizes that mixture of these additive metals with vanadia may occur to form high melting ternary, quaternary, or higher component reaction mixtures. Examples of such additional ternary and quaternary compounds are shown in Table B.

TABLE B

| COMPOUND | M.P. °F. |
|---|---|
| $VO—TiO_2—ZrO_2$ | <1800 |
| $Ba_3—V—Ti_2O_9$ | <1800 |
| $BaO—K_2O—TiO_2—V_2O_4$ | <1800 |
| $BaO—Na_2O—TiO_2—V_2O_5$ | <1800 |

It is also recognized that in treating a sulfur containing high boiling carbo-metallic containing oil feed and regeneration of the sorbent material comprising metal contaminant deposits in the presence of an oxygen containing gas, vanadium will also likely form compounds, such as vanadium sulfides, sulfates, and oxysulfides, which may also form binary, ternary, quaternary or higher component reaction mixtures with the metal additives identified by this invention disclosure.

While not wishing to be bound by any one theory or mechanism, it has been observed that a reaction of the metal additive with vanadia generally yields a binary reaction product. In the case of manganese acetate for example, reacting with vanadium pentoxide, the compound formed was tentatively identified as $Mn_2 V_2 07$. When titania was reacted with vanadium pentoxide, no true compound could be identified because the reaction is believed to involve the substitution of $Ti^{+4}$ in the crystalline structure by $V^{+4}$. Thus, the disappearance of the titania x-ray pattern and the vanadium pentoxide x-ray pattern was observed, indicating vanadium substitution.

The metal additives may be compounds of magnesium, calcium, barium, titanium, zirconium, manganese, indium, lanthanum, or a mixture of the compounds of these metals. Where the additive is introduced directly into the high pore volume sorbent demetallizing process, that is into a riser contact zone or a falling particle contact zone, into the regenerator or into any intermediate section thereof, the metal additives are preferably organo-metallic compounds soluble in the hydrocarbon feed or in a hydrocarbon solvent miscible with the feed. Examples of preferred organo-metallic compounds are tetraisopropyltitanate, Ti $(C_3H_3O\ )\ 4$, available as TYZOR from the DuPont Company; methylcyclopentadienyl manganese tricarbonyl (MMT), Mn $(CO)_3$ $C_6H_7$; zirconium isopropoxide, Zr $(C_3H_7O)$ 4; barium acetate, Ba $(C_2H_3O_2)$ 2; calcium oxalate, Ca $(C_2O_4)$; magnesium stearate, Mg $(C_{18}H_{35}O_2)$ 2; Indium 2,4 pentanedionate—In $(C_5H_7O_2)3$; Tantalum ethoxide—Ta $(C_2H_5OW0)5$; and zirconium 2,4—pentanedionate—Zr $(C_5H_7O_2)4$. Other preferred process additives include titanium tetrachloride and manganese acetate, both of which are relatively inexpensive. These additives are only a partial example of the various materials available and others would include alcoholates, esters, phenolates, naphthenates, carboxylates, dienyl sandwich compounds, and various inorganic compounds soluble in hydrocarbon solvents.

The organo-metallic additives may be introduced directly into the hydrocarbon treatment or visbreaking zone, preferably near the bottom of a riser reaction zone so that the metal additive will be deposited on the sorbent particulate before or along with the heavy metals in the oil feed. When the additive metal in the sorbent material of the invention reaches the regenerator, its oxide is formed, either by decomposition of the additive directly to the metal oxide or by decomposition of the additive to the free metal which is then oxidized under the regenerator conditions. This provides an intimate mixture of metal additive and undesired heavy metal contaminants in the feed and is believed to be a most effective method for tying up vanadium pentoxide as soon as it is formed in the regenerator. The metal additive may be introduced into the riser visbreaker zone by mixing it with the feed in an amount sufficient to give an atomic ratio between the metal additive and the vanadium in the feed of at least 0.25, preferably in the range of 0.5 to 3.0. The addition of metal additive is preferably delayed until significant levels of metal deposits are accumulated so that the economics of the process will be preserved as long as possible.

If the metal additive is added directly to the sorbent during sorbent manufacture or at some other time before the sorbent is introduced into the riser reactor, the metal additives are preferably water soluble inorganic salts of these metals, such as the acetate, halide, nitrate, sulfate, sulfite and/or carbonate. If the metal additive is not added to the sorbent before or during particle formation, then it can be added by impregnation techniques to the dried sorbent particles which are preferably spray dried microspheres.

Inorganic metal additives may be introduced into the process system of FIG. 1 discussed below along with water containing streams, such as can be used to directly cool the solids in the regenerator or to lift, fluidize or strip sorbent solid material.

A sorbent material particularly suitable for demetallizing high boiling residual oils and reduced crudes is a dehydrated kaolin clay of large pore volume. According to analysis, a kaolin clay contains about 51 to 53% (wt %) $SiO_2$, 41 to 45% $Al_2O_3$ and 0 to 1% $H_2O$, the remainder consisting of small amounts of originally present impurities. Although these impurities may include titanium, this titanium is bound up in the clay and is not in a form capable of tying up significant amounts of vanadium. In order to facilitate spray drying, a powdered dehydrated kaolinite clay is dispersed in water under conditions to form a suspension or a slurry of solids which will provide random orientation contributing to large pore volume. In preferred preparation cases in order to achieve attrition resistance and a greater pore volume and avoid expensive calcination, a binder material consisting of silica, alumina, calcium, boria, magnesia or titania may be employed.

The spray driers used can have countercurrent or cocurrent or a mixed countercurrent/cocurrent movement of the suspension and the hot air for the production of microspheres. The air can be heated electrically or by other indirect means. Combustion gases, such as those obtained in the air from the combustion of hydrocarbon heating oils, can also be used.

If a cocurrent dryer is used, the air inlet temperature can be as high as 649° C. (1200° F.) and the clay should be charged at a rate sufficient to guarantee an air outlet temperature of about 121° to 316° C. (250° to 600° F.). At these temperatures the free moisture of the suspension is driven away without removing the water of hydration (water of crystallinization) from the crude clay component. A dehydration of part or all of the crude clay during the spray drying may be envisioned. The product of the spray dryer can be separated in order to obtain microspheres of the desired particle size. Calcination of the particles although not necessarily required, can be completed after the addition of one or more metal components herein identified or by introducing the spray-dried particles before metal addition directly into a calcining operation.

Although it is advantageous in some cases to calcine the microspheres at temperatures of about 1600° to 2100° F. in order to obtain particles of maximum hardness, it is also possible to dehydrate the microspheres by calcining at lower temperatures. Temperatures of about 1000° to 1600° F. can be used, to transform the clay into a material known as "metakaolin". After calcination, the microspheres should be cooled down and, if necessary, fractionated to obtain the desired particle size range.

Example of Titania Containing Sorbent

| MATERIALS | AMOUNT |
|---|---|
| (A) Tap Water | 11 liters |
| (B) $Na_2SiO_3$- PQ Corp. 'N'Brand | 8.35 liters |
| (C) Concen, $H_2SO_4$ | 1.15 liters |
| (D) Alum | 0.8 kg. |
| (E) Clay - Hydrite AF | 12 kg. |
| (F) Titania - DuPont Anatase | 5 kg. |
| (G) Sodium Pyrophosphate | 150 gm. |

In one specific example, ingredients G, E, and F in this order are added while mixing to 8 liters of water at a pH of 2 and ambient conditions to obtain a 70 wt % solids slurry which is held for further processing.

Tap water (A) is added to a homogenizing mixer (Kady Mill) with sulfuric acid (C) and mixed for five minutes. Sodium silicate B is then added continuously over a fifteen minute period (600 ml/min.) to the stirred acid solution to provide a silica sol.

The 70 wt % solids slurry from the first step is then added to a stirred Kady Mill and mixed for fifteen minutes. The pH of the solution is maintained at 2.0–2.5 by addition of acid if needed. The temperature during addition, mixing, and acidification is maintained below 120° F. and the viscosity of the solution adjusted to 1000 CPS by the addition of water.

The resulting mixture is immediately atomized, i.e. sprayed, into a heated gaseous atmosphere, such as air and/or steam having an inlet temperature of 400° C., and an outlet temperature of 130° C., using a commercially available spray drier. The resulting microspherical particles are washed with 20 liters of hot water and dried at 350° F. for 3 hours. This yields a sorbent containing 25 wt % titanium as titanium dioxide on a volatile free basis.

In some examples of sorbent preparation, mixing and subsequent spray drying take place rapidly to prevent premature setting of a gel. In this connection, the silica sol and the solids slurry may be added separately to a spray drier nozzle and the two streams mixed instantaneously and homogeneously. Such a mixing process is described in U.S. Pat. No. 4,126,579, which is incorporated herein by reference. The air atomizer should feed the two components into the nozzle at pressures of about 30 to 90 psi and maintain the air in the nozzle at about 50 to 60 psi, preferably about 51–53 psi. As an alternative to premixing with either component, the metal additive may also be fed separately to the nozzle via a separate line operated at pressures of about 30 to 90 psi.

Titania Impregnated Sorbent

Seventy-five grams of sorbent (not calcined) is dried at 100° C. under vacuum for two hours. 2.4 ml of DuPont's Tyzor TPT (tetra isopropyl titanate) is dissolved in 75 ml. of cyclohexane. The titanium solution is added to the vacuum dried sorbent and allowed to contact with agitation for 30 minutes. Excess solution is then stripped from the impregnated sorbent to yield dried solid particles. The sorbent is then humidified. The sorbent is then regenerated (organic moieties burned off) as a shallow bed in a furnace at 900° F. for 6 hours. This procedure yields a sorbent containing 0.53 wt % Ti on sorbent.

Additive Mixed with Sorbent

As another preferred embodiment of the invention, the metal additive may be incorporated directly into the sorbent material. To an aqueous slurry of the raw sorbent material is mixed the metal additive in an amount to yield approximately 1 to 25 wt % concentration on the finished sorbent. The metal additive can be added in the form of a water soluble compound such as the nitrate, halide, sulfate, carbonate, or the like, and/or as an oxide or hydrous gel, such as titania or zirconia gel.

Other active gelatinous precipates or other gel like materials may also be used. This mixture may be spray dried to yield the finished sorbent as a microspherical particle of 10 to 200 microns in size with the active metal additive deposited within the matrix and/or on the outer surface of the catalyst particle. Since the concentration of vanadium on spent sorbent can be as high as 4 wt % of particle weight, the concentration of additive metal is preferably in the range of 1 to 8% as the metal element. More preferably, there is sufficient metal additive to maintain at least the preferred minimum atomic ratio of additive metal to vanadium at all times.

Moving Bed Sorbent

A hydrosol containing the sorbent materials described in this invention is introduced as drops of hydrosol into a water immiscible liquid wherein the hydrosol sets to spheroidal bead-like particles of hydrogel. The larger size spheres are ordinarily within the range of about 1/64 to about ¼ inch in diameter. The resulting spherical hydrogel beads are dried at 300° F. for 6 hours and calcined for 3 hours at 1300° F. The use of these calcined spherical beads is of particular advantage in a moving bed process.

Representative feedstocks contemplated for demetallizing treatment according to this invention include any oil fraction comprising undesired metal levels for catalytic cracking thereof such as whole crude oils; atmospheric gas oils, heavy vacuum gas oils and heavy fractions of crude oils included with topped crude, reduced crude, vacuum fractionator bottoms, other fractions containing heavy residua, coal-derived oils, shale oils, waxes, untreated or deasphalted residua and blends of such fractions with gas oils and the like. Thus, a relatively small amount (5–25%) of a demetallized reduced crude or other heavy hydrocarbon feedstock may be mixed with atmospheric or vacuum gas oils to provide a feedstock for catalytic conversion. A high vanadium containing oil feed for FCC processing is one having more than 0.1 ppm vanadium up to about 5.0 ppm. A high vanadium feed for RCC processing on the other hand is one having more than 1.0 ppm vanadium and usually more than about 5.0 ppm.

A carbo-metallic feed to be visbroken and demetallized according to this invention is one in a specific example boiling above 650° F. having a heavy metal content of at least about 4 ppm nickel equivalents, (ppm total metals being converted to nickel equivalents by the formula: Ni Eq.+Ni+V/4.8+Fe/7.1+Cu/1.23), a Conradson carbon residue value greater than about 1.0, and a vanadium content of at least 1.0 ppm. The feedstocks for which the method of this invention is particularly useful will have a heavy metal content of at least about 5 ppm of nickel equivalents, a vanadium content of at least 2.0. The greater the heavy metal content, the greater the proportion of vanadium in that heavy metal content, and the higher the Conradson carbon content of the material boiling above 1025° F., the more advantageous is the increased high pore volume solid sorbent material of this invention with and without metal additives and use thereof as herein provided.

A particularly preferred hydrocarbon feedstock for demetallization and upgrading treatment by the method of the invention includes a fraction of crude oil comprising 70% or more of a 650° F.+material having a resid fraction greater than 20% boiling above 1025° F. at atmospheric pressure, a metals content of greater than 5.5 ppm nickel equivalents of which at least 5 ppm is vanadium, a vanadium to nickel atomic ratio of at least 1.0, and a Conradson carbon residue greater than 4.0. This identified residual oil feed may also have a hydrogen to carbon ratio of less than about 1.8 and coke precursors in an amount sufficient to yield about 4 to 14% or greater coke by weight based on fresh feed.

Sodium vanadates have low melting points and may also flow and cause particle coalescence in a similar manner to vanadium pentoxide. Although it is desirable to maintain low sodium levels in the feed in order to minimize coalescence, as well as to avoid sodium vanadates on the sorbent, the metal additives of the present invention are also effective in forming compounds, alloys, or complexes with sodium vanadates so as to prevent these compounds from melting and flowing.

With respect to the tolerance levels of heavy metals on the high pore volume sorbent itself, such metals may accumulate on the sorbent to levels in the range of from about 3,000 to 70,000 ppm of total metals, and more usually to high levels in the range of 10,000 to 30,000 ppm, of which a large proportion thereof is vanadium.

The demetallizing decarbonizing and hydrothermal visbreaking process of the invention will produce large amounts of coke initially deposited as hydrocarbonaceous material in amounts up to 14 percent by weight based on the weight of fresh feed. This carbonaceous material deposit often referred to as coke is laid down on the sorbent particle material in amounts in the range of about 0.3 to 3 percent by weight of sorbent, depending upon the sorbent to oil ratio (weight of sorbent to weight of feedstock) employed in the demetallizing and decarbonizing zone such as a riser contact zone. The severity of the thermal visbreaking operation affected in the presence of steam and/or water should be sufficiently low however, so that thermal conversion of the feed to gasoline and lighter products is kept relatively low and preferably below 20 volume percent. Even at these low levels of conversion severity, whether thermal and/or some catalytic, the hydrothermal visbreaking process is effective for reducing the Conradson carbon value of the feed at least 20 percent, preferably in the range of 40 to 70 percent, and reduce the heavy metal content of the residual oil feed by at least 50 percent and preferably in the range of 75 to 90 percent.

The high boiling feed to be demetallized and decarbonized by the sorbent material of this invention is introduced in one embodiment into a bottom portion of a riser reaction zone under conditions to form a suspension with hot sorbent particulate material separately introduced and provided in accordance with this invention. Steam, naphtha, water, flue gas and/or some other suitable diluent material such as nitrogen or carbon dioxide is introduced separately to the riser or along with the high boiling feed to aid atomized and vaporized contact of the feed with the solid sorbent particulate material and form a fluidizable suspension therewith. These diluents may be from a fresh source or may be recycled as purity permits from a process stream of a refinery operation in association therewith.

Where recycle diluent streams are used, they may contain hydrogen sulfide and other sulfur compounds which may help passivate adverse catalytic activity by heavy metals accumulating on the sorbent material. It is to be understood that water may be introduced either as a liquid or as steam. In the interest of energy conservation, the water is preferably introduced as a liquid.

Water is added primarily as a source of vapor for dispersing the feed in intimate contact with sorbent particles, for reducing the oil partial pressure and for accelerating the feed and sorbent formed suspension to achieve the vapor velocity and hydrocarbon residence time desired in a riser contact zone.

As the high boiling feed travels up the riser under visbreaking conditions herein specified, it forms four products known in the industry as dry gas, wet gas, naphtha, and a high boilin demetallized and decarbonized oil product suitable as for use as feed to a reduced crude or cracking operation or in some cases the feed may be suitably charged to a conventional FCC operation. At the upper end or discharge end of the riser, the sorbent particles are preferably quickly separated from product vapors to minimize thermal cracking and catalytic to the extent present. The solid sorbent particles which contain metals and carbonaceous deposits formed in the riser contact zone are sent to a regenerator operation to burn off the carbonaceous deposits. The separated product vapors are normally sent to a fractionator for separation to provide the four basic products above identified.

The preferred conditions for contacting feed and sorbent in the riser are summarized in Table C, in which the abbreviation used have the following meanings: "Temp." for temperature, "Dil." for diluent, "pp" for partial pressure, "wgt" for weight, "V" for vapor, "Res." for residence, "S/O" for sorbent to oil ratios, "sorb." for sorbent, "bbl" for barrel, "MAT" for microactivity by the MAT test using a standard Davison feedstock, "Vel." for velocity, "cge" for charge, "d" for density and "Reg." for regenerated.

TABLE C

| Parameter | Sorbent Riser Conditions: Broad Operating Range | Preferred Range |
|---|---|---|
| Feed Temp. | 400-800° F. | 400-650° F. |
| Steam Temp. | 20-500° F. | 300-400° F. |
| Reg. Sorbent Temp. | 900-1500° F. | 1150-1400° F. |
| Riser Exit Temp. | 800-1400° F. | 900-1100° F. |
| Pressure | 0-100 psia | 10-50 psia |
| Water/Feed by Wt. | 0.01-0.30 | 0.04-0.15 |
| Dil. pp/Feed pp | 0.25-3.0 | 1.0-2.5 |
| Dil. wgt/Feed wgt | ≦0.4 | 0.1-0.3 |
| V. Res. Time | 0.1-5 | 0.5-3 sec. |
| S/0, wgt. | 3-18 | 5-12 |
| Lbs. Sorb./bbl Feed | 0.1-4.0 | 0.2-2.0 |
| Inlet Sorb. MAT | <25 vol. % | <20 |
| Outlet Sorb. MAT | <20 vol. % | <10 |
| V. Vel. | 25-90 ft./sec. | 30-60 |
| V. Vel./Sorb. Vel. | ≧1.0 | 1.2-2.0 |
| Dil. Cge. Vel | 5-90 ft./sec. | 10-50 |
| Oil Cge. Vel. | 1-50 ft./sec. | 5-50 |
| Inlet Sorb. d | 1-9 lbs./ft.$^3$ | 2-6 |
| Outlet Sorb. d | 1-6 lbs./ft.$^3$ | 1-3 |

In treating carbo-metallic containing oil feedstocks in accordance with the present invention, the regenerating gas may be any gas which can provide oxygen to convert carbonaceous deposits to carbon oxides. The amount of oxygen in the regeneration gas required per pound of coke for combustion depends upon the carbon dioxide to carbon monoxide ratio desired in the effluent flue gases and upon the amount of other oxidizable materials present in the coke, such as hydrogen, sulfur, nitrogen and other elements capable of forming gaseous oxides at regenerator temperature conditions.

The regenerator for the solid sorbent particulate material is operated at temperatures in the range of about 1000° F. up to 1600° F., preferably 1150° to about 1400° F. or 1500° F. to achieve combustion of carbonaceous deposits while keeping sorbent temperatures below that at which significant sorbent degradation can occur. In order to control the regenerator temperatures, it is necessary to control the rate of burning which, in turn, can be controlled at least in part by relative amounts of oxidizing gas employed and carbonaceous material introduced into the regeneration zone per unit of time. The rate of introducing carbonaceous material into the regenerator is controlled by regulating the rate of flow of sorbent thereto; the rate of removal of regenerated sorbent is controlled and the rate of introducing oxidizing gas is controlled. These parameters may be regulated such that the ratio of carbon dioxide to carbon monoxide in the effluent gases is less than about 4.0 and preferably less than about 1.5 or less so that the flue gas is CO rich. In addition, water, either as liquid or steam, may be added to the regenerator to help control temperatures therein and to influence CO production in preference to carbon dioxide. On the other hand, only a portion of the separated sorbent material may be passed to the regenerator with the remaining portion thereof recycled directly to the riser reactor following high temperature stripping in admixture with regenerated particulate material passed to the riser.

The regenerator carbonaceous material combustion reaction is carried out so that the amount of carbon remaining on regenerated sorbent is less than about 0.50 and preferably less than about 0.25 percent on a substantially moisture-free weight basis.

When a metal additive is provided with the solid sorbent material it is introduced as an aqueous or hydrocarbon solution or as a volatile compound during the processing cycle. It may be added at any point of sorbent travel in the processing system. This would include, but not be limited to the addition of the metal additive to a bottom portion of the riser reactor along the riser reactor length to a dense bed of solids in a collector vessel about the upper end of the riser, to the strippers provided in the system, to the regenerator air inlet, separately to the regenerator bed of solids, and to the regenerated sorbent standpipe.

The high pore volume sorbent material of this invention with or without the metal additive is charged for use in a hydrothermal visbreaking operation a herein described in the absence of added molecular hydrogen.

Referring now to FIG. 1 by way of example, sorbent particle circulation and operating parameters are brought up to process conditions by methods well-known to those skilled in the art. The high temperature sorbent material of regeneration at a temperature in the range of 1150°-1400° F. contacts the high boiling residual oil feed charged in a bottom or upper portion of the riser reactor depending on contact time desired therein. A fluidizing gas may initially suspend the sorbent solids before contact with charged oil feed. The oil feed is dispersed with a diluent, steam, water, flue gas or a combination thereof injected at point 2. Water and/or naphtha may be initially injected as required at point 3 to suspend solids and aid in feed vaporization, sorbent fluidization and controlling contact time of a formed suspension of solids and gasiform material in a bottom initial portion of riser 4. The sorbent and gasiform material comprising vaporous and unvaporized high boiling hydrocarbons travel up through riser 4 for a contact time restricted to within the range of 0.1-5 seconds, preferably 0.5-3 seconds or whatever is required to achieve desired demetallization and decoking in the absence of substantial thermal and/or metals conversion of charged oil. The sorbent comprising hydrocarbonaceous and metal deposits is rapidly separated from vaporous hydrocarbons at the riser outlet 6 at a temperature in the range of 900°-1100° F. A gasiform material comprising vaporous hydrocarbons, steam, wet and dry gaseous materials pass through one or more cyclones such as a multistage cyclone represented by cyclone 7 wherein entrained sorbent particles are separated and recovered by diplegs provide with the gasiform material comprising hydrocarbon vapors being sent to a fractionator (not shown) via transfer line 8. The sorbent particle material comprising hydrocarbonaceous material decomposition products of the feed components boiling above 1025° F. and metal deposits are collected as a downwardly flowing fluid bed of solids countercurrent to stripping gas introduced by 21 to stripper 10 for further removal of any entrained or formed hydrocarbon vapors before all or a portion thereof is passed to a regenerator vessel 11 to form a dense fluidized bed of solid 12 to be regenerated. An oxygen containing gas such as air with or without oxygen enrichment or carbon dioxide mixed with an oxygen containing gas is admitted to the dense fluid bed of solids 12 in regeneration vessel 11 maintained under conditions to burn carbonaceous deposits and form carbon oxides and other combustion products as herein identified. The resulting flue gas which may or may not be CO rich, depending on the operation selected is processed through cyclones 22 and exits from regenerator vessel 11 via line 23. The regenerated solid sorbent particulate containing less than 0.5 weight percent carbon is transferred to stripper 15 for removal as required of any entrained combustable gases and before transfer to a bottom portion of the riser via line 16 to repeat the cycle. The regenerated solids may also be stripped in the withdrawal well in the upper portion of bed 12 by means not shown.

In one embodiment of this invention, a portion of the recovered solid sorbent material contaminated with hydrocarbonaceous material and metal deposits may bypass the regenerator vessel through conduit 42 for recycle to the riser reactor following high temperature stripping thereof in admixture with hot freshly regenerated catalyst. This method of operation may be relied upon to reduce the regenerated catalyst temperature as well as effect further high temperature visbreaking of deposited hydrocarbonaceous materials. It is even contemplated removing some carbonaceous deposits by reacting with a $CO_2$ rich gas in such a zone between the regenerator and riser reactor.

The bypass of the regenerator as above identified may be used to reduce vanadium oxidation, to increase thermal decomposition of liquid hydrocarbons as well as reduce regeneration temperatures by reducing the amount of carbonaceous deposits charged to the regenerator. Other advantages will be apparent to those skilled in the art.

In a particular embodiment it is desirable in regeneration of the sorbent material to effect combustion of carbonaceous deposits sufficient to provide a solid sorbent particle containing less than 0.2 weight percent carbon and preferably less than 0.10 weight percent carbon.

At such time that the metal level on the sorbent becomes intolerably high such that sorbent effectiveness drops to an undesired low level or a desired equilibrium condition is exceeded, additional sorbent material can be added to replace deactivated sorbent withdrawn by conduits 42 and 43. Points 18 and 19 can be utilized to add virgin sorbents with or without metal additives. In the case of a virgin sorbent prepared without additive, the metal additive as an aqueous solution or as an organo-metallic compound in aqueous or hydrocarbon solvents can be added at points 18 and 19, as well as at addition points 2 and 3 on feed line 1, addition points 20 and 20$^1$ in riser 4 and addition point near the bottom of vessel 5 may also be employed for this purpose. The addition of the metal additive is not limited to these locations, but can be introduced at any point in the oil/sorbent processing cycle. Inlet conduits 20 and 20$^1$ are also for the purpose of adding feed to be demetallized and decarbonized to obtain different contact times in the riser.

Examples of Additive Addition

This application describes a new and novel approach to offsetting the adverse effects particularly of vanadium pentoxide by the use of large pore volume clay sorbent material with or without one or more select added metals herein identified, as their oxides or their salts as discussed above. These metal additives serve particularly to immobilize vanadia by creating complexes, compounds or alloys of vanadia having melting points which are higher than the temperatures encountered in the regeneration zone. These metal additives based on the metal element content of the sorbent may be used in concentrations in the range of from about 0.5 to 25 percent, more preferably about 1 to 8 percent by weight of virgin sorbent. When adding the one or more immobilizing metals during the visbreaking operation, the metal elements may be built up to a much higher concentration as equilibrium sorbent material and the maintained at a desired level by sorbent replacement.

The sorbent material which may be employed according to this invention include clay solids of little or no catalytic activity providing a particle oore volume of at least 0.4 cc/g and may include some catalytically spent cracking catalysts. However, clays prepared in accordance with this invention which are considered relatively inert because of low activity catalytically below about 20 MATS are employed with some degree of preference. Clays suitable for this purpose include bentonite, kaolin, montmorillonite, smectites, and other 2-layered lamellar silicates, mullite, pumice, silica, laterite, and combinations of one or more of these or like materials. The surface area of these sorbents are altered during preparation according to this invention by substantially increasing the pore volume thereof to at least 0.4 cc/g or greater then 0.5 cc/g and preferably the clays have a micro-activity value as measured by the ASTM Test Method No. D3907-80 of below 20.

As one example of additive involvement, tetraisopropyltitanate (TPT) was mixed with a heavy gas oli (HGO) to form a solution of 1 part TPT to 1 part HGO. This solution was added to the oil feed line to the riser in an amount sufficient to yield 1 part titanium by weight to 1 part vanadium in the feed. The oil feed charged to the riser was a reduced crude processed at 600,000 lbs. per day with a vanadium content of 20 ppm. Based on the vanadium content and the molecular weight of the TPT, this equated to adding 420 lbs. of TPT per day to 600,000 lbs. of reduced crude feed per day.

Figure 2:
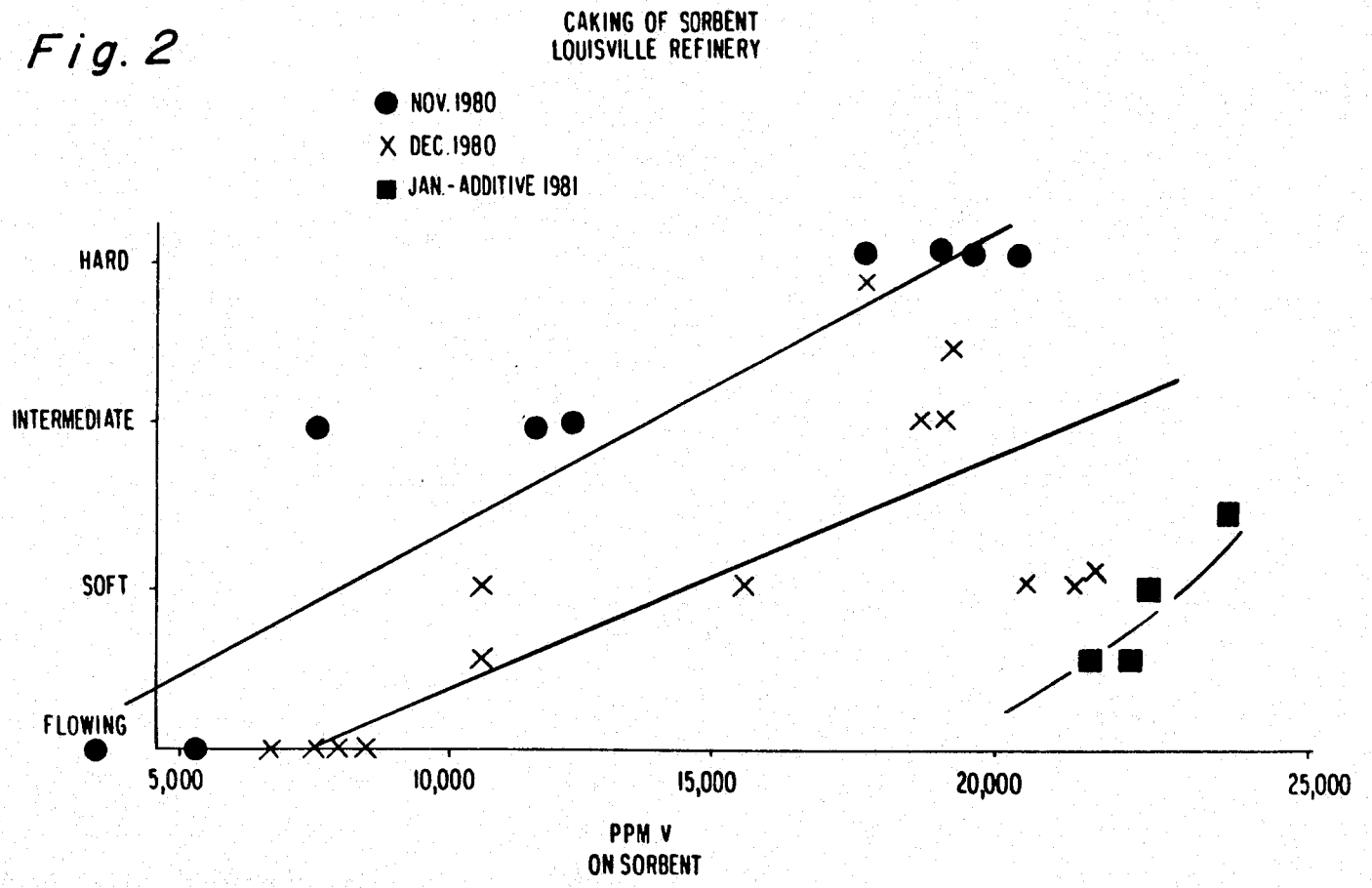
FIG. 2 is a graph showing changes in sorbent properties with increasing amounts of vanadium on the sorbent and the effect of a metal additive on sorbent properties.

The results of adding TPT to the sorbent are shown in FIG. 2. Sorbent samples at varying vanadium levels were taken during two process periods (dots and X's) when the additive of the invention was not utilized, and similar samples were taken during additive addition (boxes). These samples were then subjected to the clumping test described below to determine the flow characteristics of vanadia containing sorbent particles. The vanadia containing sorbent samples were placed in individual ceramic crucibles, dried and calcined at 1400° F. in air for two hours. The crucibles were cooled to room temperature. Vanadia, while liquid at operating temperature (1400° F.), will flow across the sorbent surface and cause sorbent particle coalescence when cooled down below the solidification point. The degree of coalescence shown in FIG. 2 is a visual and mechanical estimation of particle fusion, namely, flowing—no change in flow characteristics between virgin sorbent and use sorbent; soft—substantially all of used sorbent free flowing with a small amount of clumps easily crushed to obtain free flowing sorbent; intermediate—-free flowing sorbent containing both free flowing particles and fused masses in approximately a 1:1 ratio; and hard—substantially all of the sorbent particles fused into a hard mass with very few free flowing particles.

The sorbent of FIG. 2 was used in the treatment of a reduced crude to lower vanadium and Conradson carbon values. In two extended runs of approximately 30 days (dots and X's), the sorbent particles began to show coalescence properties at vanadium levels of 10,000 ppm, and by 20,000 ppm had showed coalescence into a hard mass (loss of fluidization properties). In the third period (boxes), the additive TPT was added during the processing cycle to a hydrocarbon solution of gas oil as discussed above. This additive permitted operation in the 20,000 to 25,000 ppm level of vanadium without any loss in fluidization through particle coalescence.

Another example of a metal additive identified above was the use of methylcyclopentadienyl manganese tricarbonyl (MMT). Two drums of this material were added over a two hour period to at least partially immobilize the vanadium on the sorbent. Each drum weighed 410 lbs. and contained 25 wt % MMT in a hydrocarbon solvent. Based on a manganese concentration of 28.3 wgt % Mn in MMT and a circulating sorbent inventory of 42 tons, approximately 700 ppm Mn was deposited on the sorbent. The MMT additions also improved the circulating efficiency of the sorbent by reducing particle coalescence.

Figure 3:
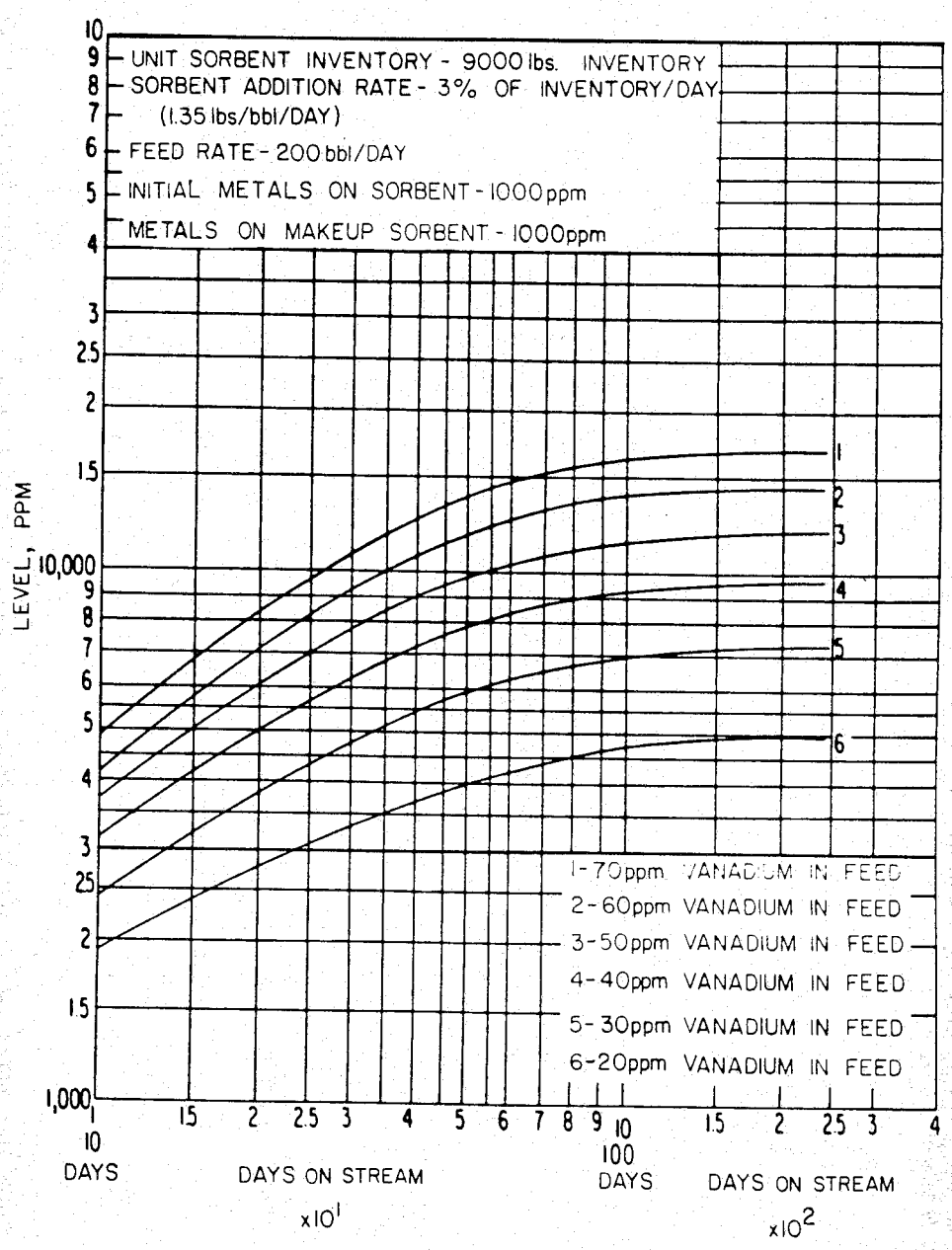
FIG. 3 is a graph showing the time required to build up vanadium on a sorbent at varying vanadium levels in a feed and a sorbent addition rate of 4% of inventory.
Figure 4:
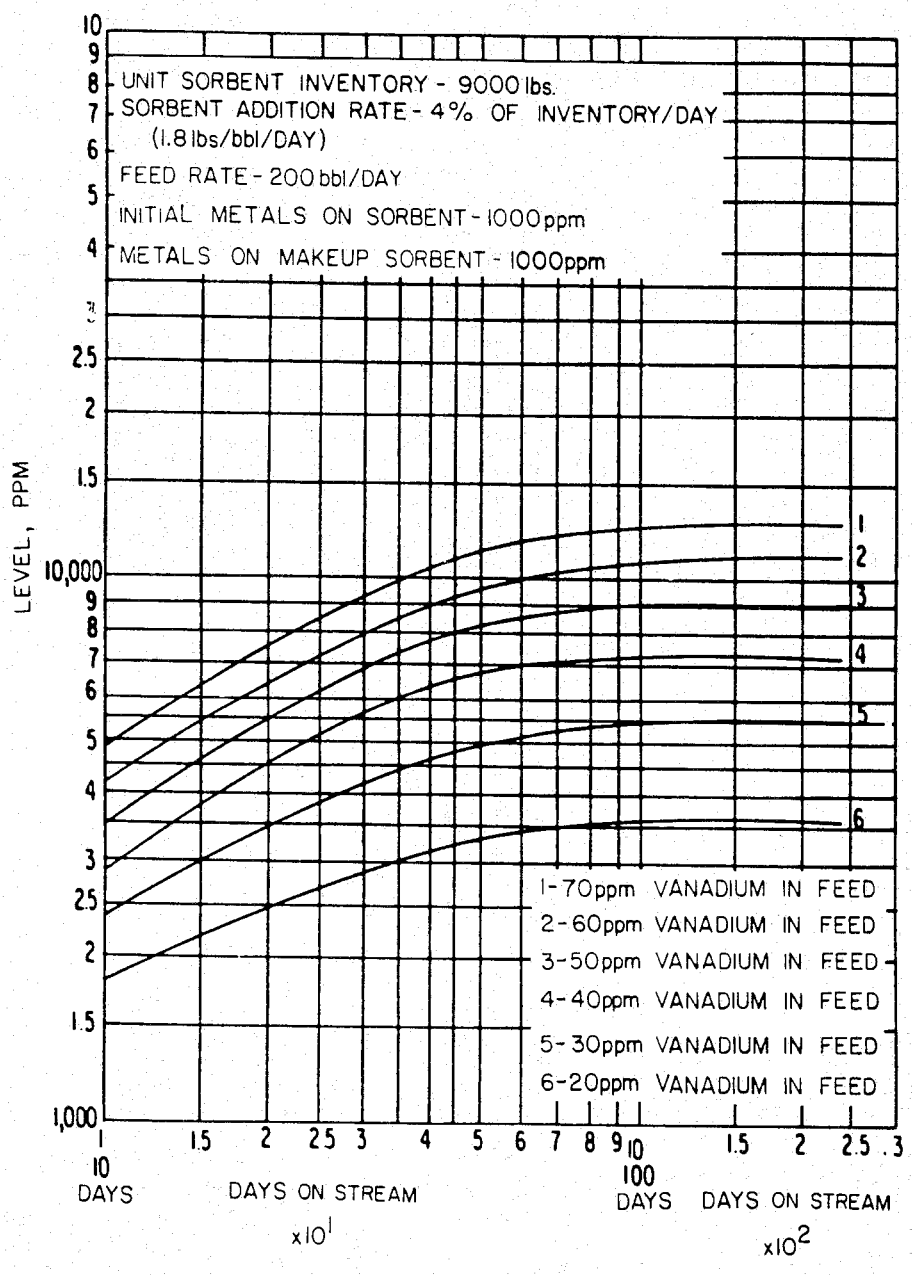

In a fluidized solids system represented by FIG. 1, the rate of metals build up on the circulating sorbent is a function of metals in the feed, the sorbent circulating inventory, the sorbent addition and withdrawal rates, the sorbent to oil ratio and the sorbent pore volume. FIGS. 3 and 4 give the rate of metal buildup on a circulating sorbent at constant inventory, constant sorbent addition and withdrawal rate and varying metals content in the feed. These figures show that for feed metals levels of 20–70 ppm, total metal levels on the sorbent equilibrate after about 90–150 days. Thereafter, the metals level on sorbent remains constant with time. By utilizing these figures, or similar figures that can be developed for higher metals levels and higher porosity material (pore volume) addition rates and preselected circulating inventories, the required concentrations of the metal additives provided with the sorbent material can be determined so as to yield a preferred minimim atomic ratio of metal additive to vanadium content.

For example, in FIG. 3, this particular unit has 9,000 lbs. of sorbent inventory, a sorbent addition rate of 1.35 lb./bbl. of feed per day, and a feed rate is 200 lb./day. Assuming the metals content is all vanadium, Curve 1 in FIG. 3 would be utilized to show that after 150 days of continuous operation with 70 ppm vanadium in the feed, the vanadium level on the catalyst would equilibrate at about 17,000 ppm and then remain constant with time. Thus, in preparing a sorbent particulate containing a titania additive, the sorbent is prepared such that it will contain at least 8,500 ppm titanium to ensure that at least 0.5 atomic ratio of titanium to vanadium is maintained during use to immobilize deposited vanadium. Similar calculations can be performed for lower and higher equilibrium vanadium values using other curves or multiples of these curves (120 ppm vanadium on sorbent would equilibrate at about 30,000 ppm under the conditions of FIG. 3).

In the high temperature treatment of residual oil feeds comprising components boiling above 1025° F. and of varying vanadium content herein referred to as hydrothermal visbreaking, thermal visbreaking or hydrovisbreaking the rate of vanadium buildup on a high pore volume sorbent and the uppermost predetermined and selected level of metal contaminants permitted on the solid sorbent before replacement with sorbent of less metals is a function of metals content of the feed and particularly the vanadium content of the feed. A predetermined upper limit of metal contaminants may be referred to as equilibrium state for addition and withdrawal rates maintained so as not to exceed the preselected upper metals level for the selected state of equilibrium. Table G presents a typical case for a 40,000 bbl./day unit in which the vanadium content of the feed is varied from 1 ppm up to 25 and then to 400 ppm. In order to restrict preselected levels of vanadium on the sorbent at an upper predetermined equilibrium state equated to additive immobilizing metal and capacity of sorbent material, the sorbent addition or replacement rate can be varied to yield the equilibrated vanadium values of from 5,000 to 30,000 ppm. As explained elsewhere, vanadium, as vanadium pentoxide and/or sodium vanadate on the sorbent, undergoes melting at regenerator temperatures above 1200° F. and flows across the sorbent surface, causing particle fusion and coalescence.

Table H presents an economic advantage for introducing an additive into the riser as an aqueous or hydrocarbon solution. Table H demonstrates the economic differential (savings in $/day) that can be realized by utilizing the additives and operating at the 30,000 ppm level versus the 10,000 ppm level of vanadium on sorbent.

As shown in Table H, treatment of a feedstock having 1 ppm vanadium for FCC operations would show a savings of at least $28/day with TPT as the additive and $168/day with titanium tetrachloride as the additive. In comparison, treatment of a heavy hydrocarbon oil containing 25 to 100 ppm vanadium for an RCC operations would show savings of at least $500 to $2,000/day with TPT as the additive and $4,000 to $22,400/day with titanium tetrachloride as the additive.

The regenerator vessel as diagrammatically illustrated in FIG. 1 is a simple one zone-dense fluid bed of solids in a single regeneration zone. The regeneration operation of this invention is not necessarily limited to the single stage regeneration operation shown but can comprise two or more separate regeneration zones in stacked or side by side relationship, with internal and/or external circulation transfer lines from zone to zone. Some multistage regenerator arrangements known in the prior art may be used with advantage or one or more arrangements described in more detail in other copending applications may be used with particular advantage.

The determination that vanadia deposited on a sorbent would flow and cause coalescence between sorbent particulate at regenerator temperatures, and the selection of those elements and their salts which would prevent this process were studied by three methods, namely: the clumping or lump formation technique, vanadia diffusion from or compound formation with a metal additive in an alumina-ceramic crucible, and through spectroscopic studies and differential thermal analyses of vanadia metal additive mixtures.

Clumping Test

A clay, spray dried to yield microspherical particles in the 20 to 150 micron size, had vanadia deposited upon it in varying concentrations. Clay free of vanadia and clay containing varying vanadia concentrations were placed in individual ceramic crucibles and calcined at 1400° F. in air for two hours. At the end of this time period, the crucibles were withdrawn from the muffle furnace and cooled to room temperature. The surface texture and flow characteristics of these samples were noted and the results are reported in Table D.

TABLE D

| $V_2O_5$ Concentration - ppm | Surface Texture | Flow Characteristics |
|---|---|---|
| 0 | Free | Free flowing |

TABLE D-continued

| $V_2O_5$ Concentration - ppm | Surface Texture | Flow Characteristics |
|---|---|---|
| 1,000–5,000 | Surface clumped | Broke crust for free flowing |
| 5,000–20,000 | Surface clumped | Total clumping no flow |

As shown in Table D, the clay free of vanadia does not form any crust or clumps or fused particles at temperatures encountered in the regenerator section of the process described in this invention. At vanadia concentrations of 1,000–5,000 ppm, clumping was observed but the crusts binding particles could be readily broken into free flowing, crusty particles. At vanadia concentrations above 5,000 ppm, the particular low pore volume clay employed begins to clump and bind badly and does not flow at all even with moderate impact. While liquid at operating temperature manifestation of this phenomenum is demonstrated by the finding that when these coalesed particles are cooled down below their solidification point in a crucible, or in an operating unit cooled down in order to facilitate entrance to the unit for cleaning out plugged diplegs and other repairs, a solid mass of sorbent is often found which must be forcibly removed. This phenomena makes process turnaround lengthy and complex for an operating unit as this material must be chipped out.

Crucible Diffusion Test

An extension oi the clumping test is the use of a ceramic-alumina crucible to determine whether vanadia reacts with a given metal additive. If vanadia does not react with the metal additive or only a small amount of compound formation occurs, then the vanadia diffuses through and over the porous alumina walls and deposits as a yellowish to orange deposit on the outside wall of the crucible. On the other hand, when compound formation occurs, there are little or no vanadia deposits formed on the outside of the crucible wall. Two series of tests were performed. In the first series shown in Table E, a 1:1 mixture by weight of vanadia pentoxide and the metal additive was placed in the crucible and heated to 1500° F. in air for 12 hours. Compound formation or vanadia diffusion was as noted in Table E.

TABLE E

1 Part $V_2O_5$ + 1 Part Metal Additive
1500° F. - Air - 12 hours

| Metal Additive | Diffusion of Vanadium | Compound Formation |
|---|---|---|
| Titania | No | Yes |
| Manganese Acetate | No | Yes |
| Lanthan Oxide | No | Yes |
| Alumina | Yes | No |
| Barium Acetate | No | Yes |
| Copper Oxide | Yes | Partial |

In the second series of tests, a vanadia containing material was tested in a similar manner. A one to one ratio by weight of vanadium pentoxide and the metal additive were heated to 1500° F. in air for 12 hours. The results are shown in Table F. The material reported in Table F as containing 24,000 ppm vanadia on clay with no metal additive was fired at 1500° F. and then studied in a scanning electron microscope (SEM). The fused particles initially gave a picture of fused particles. However, as the material was continuously bombarded, the fused particles separated due to the heat generated by the bombarding electrons. One was able to observe the melting and flowing of vanadia as the initial single fused particles separated into two or more distinct microspherical particles.

TABLE F

1 Part $V_2O_5$ – Catalyst + 1 Part Metal Additive
1500° F. - Air - 12 Hours

| Vanadia Concentration, ppm | Metal Additive | Particle Formation |
|---|---|---|
| 24,000 | None | Yes |
| 24,000 | Calcium Oxide | No |
| 24,000 | Magnesium Oxide | No |
| 24,000 | Manganese Oxide | No |

The study of the capability of certain elements to immobilize vanadium pentoxide was extended by use of DuPont differential thermal analyses (DTA), X-ray diffraction (XRD) and scanning electron microscope (SEM) instruments. The metal additives studied on the DTA showed that titania, barium oxide, calcium oxide, the lanthanide series, magnesium oxide and indium oxide all were excellent additives for the formation of high melting metal vanadates, with melting points of 1800° F. or higher. Copper gave intermediate results with compounds melting at approximately 1500° F. Poor results were obtained with materials such as lead oxide, molybdena, tin oxide, chromia, zinc oxide, cobalt oxide, cadimium oxide and some of the rare earths. The concepts of the invention described herein are useful in the treatment of both FCC and RCC feeds as described above. The present invention is particularly useful in the treatment of high boiling carbo-metallic material containing feedstock of high metals content and Conradson carbon producing components to provide products of lowered metals-Conradson carbon values suitable for use as feedstocks for FCC and more particularly for RCC units. Examples of these high boiling oils are reduced crudes, residual oils and other oils or crude oil fractions containing metals and/or residua as herein defined.

Although the visbreaking process of this invention is preferably conducted in a riser reactor because of desired restricted temperature—contact time parameters, other types of reactors may be employed with either uoward or downward solid flow. Thus the thermal visbreaking operation may be conducted with a type of downflowing moving bed of sorbent which moves in concurrent relation to liquid (unvaporized) or partially vaporized feedstock under contact conditions of pressure, temperature and weight hourly space velocity as particularly defined herein.

Sorbent Preparation

The sorbent material of the present invention and particularly comprising finely divided fluidizable particulate of a size in the range of 20 to 80 microns may be prepared by any number of different ways to provide a low catalytic activity clay of a pore volume in excess of 0.4 cc/g and one which will be thermally stable in the presence of steam at temperatures in the range of about 900° F. up to about 1600° F. As provided above, the selected clay material is mixed during preparation thereof with one or more components such as carbon black, sugar, an organic material, a polymer material or an inorganic salt which will decompose during high temperature contact to provide a clay substance of the desired porosity and thermal stability for use in the hydrothermal visbreaking operation herein discussed.

Sorbent Preparation Techniques

1. Into a homogenizing mixer called a Kady Mill was added 12 L of tap water and 25 gms. of sodium pyrophosphate hydrate. The phosphate is a surface active agent to disperse 22 kg. of a fine kaolite clay named HYDRITF UF. The clay was added over a 15 minute period with vigorous agitation.

The following is a typical chemical analysis of a HYDRITE kaolinite:

| | | | |
|---|---|---|---|
| Aluminum Oxide | 38.38 | Calcium Oxide | 0.05 |
| Silicon Dioxide | 45.30 | Magnesium Oxide | 0.25 |
| Ignition Loss at 950° C. | 13.97 | Sodium Oxide | 0.27 |
| | | Titanium Oxide | 1.44 |
| Iron Oxide | 0.30 | | |

HYDRITE UF Kaolinite, the finest kaolinite available, is further identified as follows:

| Median Particle Size (Microns) | Brightness (G.E. % of MgO | pH | 325 Mesh Residue Max. (%) | Oil Adsorption % |
|---|---|---|---|---|
| 0.20 | 82.0–85.0 | 4.2–5.2 | 0.20 | 47 |
| Aqueous Viscosity Centipoise | | | | |
| 400 | | | | |

(58% solids, 0.5% sodium herametaphosphate on weight of kaolite. Measured at 10 R.P.M. on Brookfield Viscometer.)

2. To the clay slurry was added 2.8 kg. of Catapul Alumina and the mixture was stirred for 15 minutes. Catapal Alumina is identified as Alpha Monohydrate (Boehmite) as comprising:

| | | | |
|---|---|---|---|
| $Al_2O_3$ | 74.2% | $Na_2O$ | 0.004% |
| Ignition Loss | 25.8% | $SiO_2$ | 0.003% |
| Carbon | 0.36% | Sulfur | Nil |
| $Fe_2O_3$ | 0.005% | $TiO_2$ | 0.120% |

After calcination for 3 hours 900° F. crystal structure is gamma alumina.

3. Over a three minutes period, 150 ml. of concentrated $H_2SO_4$ was dripped into the stirred slurry. Eleven liters of $H_2SO_4$ was dripped into the stirred slurry. Eleven liters of $H_2O$ was added during a 15 minute period with stirring. The resultant slurry had a pH of 3 and a viscosity of 1100 CPS at 130° F.
4. The clay slurry was spray dried at an inlet and outlet air temperature of 255° F. and 750° F. respectively.
5. The microspherical solid from the spray drier was placed in a furnace at room temperature and heated to 1850° F. in 3 hours. Heating was stopped and the material was slowly cooled to 300° F. over a 16 hour period.
6. This procedure yielded a fluidizable clay adsorbent material with 13 wt's alumina binder. The surface area was 31 $m^2/g$ and the pore volume was 0.51 cc/g with medium pore radius of 560Å.

Preparation of Clay Adsorbent with Silica Binder B600-142-1C

1. Into a homogenizing mixer (Kady Mill) was placed 17 L of tap $H_2O$ and 160 gm. of sodium pyrophosphate hydrate. With stirring, 16 kg. of HYDRITE UF Kaolinite Clay was added over a 20 minute period.
2. To this stirred clay slurry was added 2 L of "N" Brand sodium metasilicate during 5 minute period.
3. The resultant thick clay slurry was diluted with 16 L of tap $H_2O$ while mixing at 125° F.
4. The slurry was spray dried at 750° F. inlet air temperature and 250° F. outlet temperature.
5. The microspherical solid was then placed in a furnace at 80° F. and heated to 1900° F. during the next 3 hours. Heating was stopped and the material cooled to 300° F. over a 16 hour period.
6. The fluidizable clay adsorbent contained 5 wt silica binder and 93 wt % clay. The pore volume of the material was 0.41 cc/g while the surface area was 14 $m^2/g$.

Preparation of Clay Adsorbent With Carbon Black

1. Into a homogenizing mixer (Kady Mill) was added 24 liters of water and 350 gm. (0.35 kg.) of lignin ($CBO_3$-Carbon Black) as a dispersent. This mixture was agitated to thoroughly mix dispersent before adding 7 kg. of carbon black (United N219L—Particle diameter 280 Å) to the Kady Mill mixture to get the carbon black dispersed in the water. The mixture was agitated for 15 minutes. Then 32.4 kg. of HYDRITE UF Clay was added to the mixture in 4 portions over a mixing period of about 15 minutes. Following the clay addition, the mixture was further agitated for another 15 minutes to form a homogenous slurry.
2. The homogenous slurry was then spray dried at an inlet temperature of about 255° F. and an outlet temperature of about 750° F.

The product of the spray drying operation comprising microspherical solids may be heated or calcined, if desired, by heating in a furnace gradually to an elevated temperature up to 1850° F. in about 3 hours. The calcined material should then be slowly cooled to about 300° F. over an extended period up to a 16 hour period. During calcination of the spray dried material, the carbon black in the solids comprising about 20% carbon black is burned out to provide a high pore volume clay particle of at least 0.5 cc/gm.

In yet another embodiment, the present invention is concerned with maintaining a relationship in the thermal visbreaking zone between solid sorbent particulate and metals containing oil feed such that the high pore volume particulate of this invention will be used with a volume of heavy oil feed which limits filling the pores with oil feed to within the range of $\frac{1}{4}$ up to about $\frac{2}{3}$ at a preselected solids to oil ratio. In a more particular aspect, the thermal visbreaking operation is initiated with freshly prepared sorbent particle clay material of at least 0.4 cc/g pore volume and a solids to oil ratio so that only about $\frac{1}{4}$ up to about $\frac{2}{3}$ of the solids pore volume will be initially filled with heavy oil feed comprising tacky asphaltic material to minimize coalescence of particles as discussed above and to effect demetallization and decarbonization of the heavy oil feed.

The relationships herein identified with respect to pore volume, pore openings, zeolite content, catalyst to oil ratio to restrict pore filling, temperature and contact time are not only particularly desirable but a critical relationship in operating significantly contributing to the efficiency and thus economics of the thermal visbreaking operation of this invention.

The following tables G and H particularly identify with the operating efficiency and economics of the inventory. That is, Table G, identifies some sorbent addition rates identified as required to maintain vanadium metal contaminant at a given level for feeds with different levels of vanadium content. The advantage of using the large pore volume sorbent of this invention which permits operating at high metals content level is clearly identified with this data. Table H in addition to Table G is identifying further significant advantages that one can achieve by employing one of TPT and $TiCl_4$ in the sorbent for immobilizing vanadia.

TABLE G

| | | 40,000 BBL./DAY UNIT | | | |
|---|---|---|---|---|---|
| | | Level on Equilibrium Material | | | |
| Total Vanadium PPM | #Metal Day | 5000 0.5% | 10,000 1.0% | 20,000 2.0% | 30,000 3.0% |
| | | Daily Tonnage Replacement | | | |
| 400 | 5200 | 500 | 250 | 125 | 82 |
| 200 | 2600 | 250 | 125 | 65 | 42 |
| 100 | 1300 | 125 | 63 | 32 | 21 |
| 50 | 650 | 63 | 32 | 16 | 10 |
| 25 | 325 | 32 | 16 | 8 | 5 |

TABLE H

FEED-40,000 Bbl/Day; 1 BBL = 335 Lbs.; Ti ADDITIVE = \$12/lb. of titania content in TPT = \$1.50/bl. of titania content in $TiCl_4$

| Metals in Feed, ppm | lb. V/bbl. | lb. V/day | lb. Ti/bbl. | lb. Ti/day | Ti Cost ¢/bbl. TPT | Ti Cost ¢/bbl. $TiCl_4$ | 10,000 ppm Sorbent Add'n \$/Day(1) | 30,000 ppm Sorbent Add'n \$/Day(2) | Savings \$1/Day(3) TPT | Savings \$1/Day(3) $TiCl_4$ |
|---|---|---|---|---|---|---|---|---|---|---|
| 1 | $3.35 \times 10^{-4}$ | 13 | $3.35 \times 10^{-4}$ | 13 | 0.4 | 1.04 | 577 | 188 | 28 | 168 |
| 25 | $8.4 \times 10^{-3}$ | 325 | $8.4 \times 10^{-3}$ | 325 | 10 | 1.25 | 14,400 | 4,500 | 500 | 4,000 |
| 50 | $1.7 \times 10^{-2}$ | 650 | $1.7 \times 10^{-2}$ | 650 | 20 | 2.5 | 28,800 | 9,000 | 1,000 | 8,000 |
| 100 | $3.4 \times 10^{-2}$ | 1,300 | $3.4 \times 10^{-2}$ | 1,300 | 40 | 5 | 56,700 | 18,000 | 2,000 | 22,400 |

(1)(2)See Table G, to obtain sorbent addition rate to maintain sorbent at 10,000 ppm level and 30,000 ppm level. Sorbent cost = 45¢/lb.
(3)Sorbent cost savings based on difference between Ti cost (TPT) or ($TiCl_4$) and difference in sorbent rate cost, (1) minus (2)

Having thus generally described various aspects of the present invention and discussed specific embodiments in support thereof, it is to be understood that no undue restrictions are to be imposed by reasons thereof except as defined by the following claims.

We claim:

1. A composition of matter comprising a clay of at least 0.4 cc/g pore volume prepared by slurring kaolinite clay with a high pore volume producing dispersant material which will thermally decompose, spray drying the slurry of clay and dispersant to form microspherical solids, heating said microspherical solids to an elevated temperature over a time period up to about 3 hours and thereafter slowly cooling the heated solids to about 300° F. over a time period up to about 16 hours.

2. The composition of claim 1 wherein the thermally decomposable dispersant material is a material selected from the group of materials comprising, sugar, carbon black, a thermally decomposable organic material, a thermally decomposable inorganic material such as salts of a molecular weight and structure providing desired pore size upon decomposition.

3. The composition of claim 1 wherein the thermally decomposable dispersant material comprises carbon black.

4. A method for preparing a solid sorbent clay particles of at least 0.4 cc/g pore volume which comprises, forming a slurried mixture of kaolinite and sodium pyrophosphate in water, adding alpha monhydrate alumina to said slurry during agitated mixing of the slurry, adding sulfuric acid and water slowly to the stirred slurry to provide the slurry with a pH of about 3, spray drying the pH adjusted slurry at a temperature up to about 750° F. to form microspherical solids, heating the microspherical solids to an elevated temperature, and recovering a cooler clay sorbent particle material comprising an alumina binder and a pore volume of at least 0.5 cc/gm.

5. A method for preparing a solid clay sorbent particle material of at least 0.4 cc/gm pore volume which comprises, forming a slurry of water, lignin and carbon black, adding kaolinite clay to said slurry with stirred agitation, spray drying the slurried clay at a temperature up to about 750° F., heating the spray dried material up to a temperature of about 1850° F., slowly cooling the heated and calcined spray dried material, and recovering a clay particle material depleted of carbon black and comprising a pore volume of at least 0.4 cc/gm.

6. The solid clay sorbent particles of claim 4 to which one or more metals for immobilizing vanadium is added during preparation of the solids.

7. A method of preparing solid sorbent particulate material comprising a pore volume of at least 0.4 cc/g which comprises, forming a homogenized slurry mix of water, sodium pyrophosphate and very small particle kaolinite clay, adding sodium metasilicate to the clay slurry with stirring to produce a thick clay slurry, dilute the thick clay slurry with water while mixing at a temperature of 125° F., spray drying the diluted clay slurry at a temperature within the range of 250° F. to about 750° F. to produce microspherical solid products, heating the microspherical particles to an elevated temperature for an extended period of time, cooling the heated material, and recovering fluidizable clay adsorbent particles containing 5 weight percent of silica binder and 93 wt % of clay providing a pore volume of at least 0.41 cc/g and a surface area of at least 14 $m^2/g$.

8. A composition of matter for demetallizing and decarbonizing high boiling residual oils comprising vanadium and asphaltenes which comprises a clay sorbent material provided with a pore volume in the range of 0.4 cc/g to 0.5 cc/g and a pore opening of at least 500 Angstroms, and said clay sorbent provided with from 1 to 20 wt % of a metal or compounds of metals selected from the group consisting of silica, alumina, titanium, zirconium, barium, magnesium, calcium and mixtures thereof.

* * * * *